US005345872A

United States Patent [19]

Takahashi et al.

[11] Patent Number: 5,345,872

[45] Date of Patent: Sep. 13, 1994

[54] IGNITER

[75] Inventors: Sakae Takahashi; Hitoshi Miyazaki; Hitoshi Kunii, all of Fukushima, Japan

[73] Assignee: Nippon Koki Co., Ltd., Tokyo, Japan

[21] Appl. No.: 121,315

[22] Filed: Sep. 15, 1993

[30] Foreign Application Priority Data

May 28, 1993 [JP] Japan ..... 5-127574

[51] Int. Cl.[5] ..... F42B 3/18

[52] U.S. Cl. ..... 102/202.2; 102/202.5; 102/202.7; 102/202.14; 102/530; 280/741; 422/166

[58] Field of Search ..... 102/202.1, 202.2, 202.3, 102/202.5, 202.7, 202.9, 202.14, 530, 531; 280/741; 422/165, 166

[56] References Cited

U.S. PATENT DOCUMENTS

| | | | |
|---|---|---|---|
| 2,086,538 | 7/1937 | Burrows | 102/202.3 |
| 3,971,320 | 7/1976 | Lee . | |
| 4,422,381 | 12/1983 | Barrett | 102/202.2 |
| 4,592,280 | 6/1986 | Shores | 102/202.2 |
| 5,140,906 | 8/1992 | Little, II | 102/202.14 |
| 5,230,287 | 7/1993 | Arrell, Jr. et al. | 102/202.5 |

FOREIGN PATENT DOCUMENTS 4108460 9/1992 Japan .

*Primary Examiner*—Harold J. Tudor
*Attorney, Agent, or Firm*—Kalish & Gilster

[57] ABSTRACT

In an igniter of this invention, an insulated cup and a harness supporter for forming an igniter body are made of an insulating member and a lead electrode which is connected to the ground is electrically conducted to a header case, so that ignition of an igniting agent due to discharge of static electricity can be surely prevented.

5 Claims, 2 Drawing Sheets

IGNITER

BACKGROUND OF THE INVENTION

1. Field of the Invention

This invention relates to an igniter to be disposed in an air bag inflation gas generator or the like.

2. Description of the Prior Art

A prior shock absorber to protect a passenger car driver from shocks at collision accidents comprises an air bag and a gas generator to inflate the air bag with gas. At a collision accident of a passenger car, explosives or other gas generating agents having a similar composition thereto, which are charged in the gas generator, are ignited and burnt to produce gas. The air bag is instantaneously inflated by the resultant gas for protecting the driver against any collision shocks, thereby avoiding possible serious injury of the driver.

And, in the above type of air bag inflation gas generator, an igniter is disposed to ignite an ignition agent which burns gas generating agents.

FIG. 2 shows a conventional igniter which is disclosed in Japanese Utility Model Application Laid-open Print No. 108460/1992 for example. In the drawing, the reference numeral 11 represents a cylindrical igniter holder.

At the front of the igniter holder 11, an igniting section 12 is formed.

At the leading end of the igniter holder 11, a cup 13 is inserted. And a separator 15 is inserted in the cup 13.

In the front side of the separator 15, priming charge 17 is accommodated. And in the back side of the separator 15, a charge holder 21 is disposed to accommodate an igniting agent 19.

And, in the rear opening of the igniter holder 11, a harness supporter 23 is inserted with its top ahead and fixed within the igniter holder 11 by a caulking section 24 of the igniter holder 11.

In this harness supporter 23, harnesses 25 are plugged. These harnesses 25 are electrically connected with a heater 29 which is disposed in contact with the igniting agent 19 via lead terminals 27 of a header 26.

In FIG. 2, the reference numeral 31 represents a glass sintered member of the header 26, and 33 represents ferrite beads.

With the igniter configured as described above, when a car crashes, electricity is sent to the heater 29 through the harnesses 25 and the lead terminals 27. Then the temperature of the heater 29 rises to ignite the igniting agent 19 which in turn ignites the priming charge 17, causing an ignition agent to burn.

But, the above conventional igniter has disadvantages that when a charge holder 21 is charged with static electricity, this static electricity is discharged from the charge holder 21 to lead electrodes 27 and, in the worst case, the igniting agent might ignite. Therefore, this igniter is not preferable to be used as the igniter for an air bag inflation gas generator which is required to be very reliable.

SUMMARY OF THE INVENTION

This invention has remedied the above problems and aims to provide an igniter which is quite free from a possibility that an igniting agent is ignited by discharge of static electricity.

This invention uses an insulating member to form an insulated cup for accommodating an igniting agent and a header for igniting the igniting agent and a harness supporter in which a pair of harnesses is inserted at a certain interval therebetween. The insulated cup and the harness supporter are connected to form an igniter body. The header is formed by inserting at a certain interval a pair of lead electrodes to whose rear ends the harnesses are connected into the header body which is formed by charging a glass sintered member into a bottom-closed cylindrical header case made of conductive metal, and bridging a heater member between the leading ends of the lead electrodes. And one of the lead electrodes is electrically conducted to the header case.

In this invention, since the insulated cup and harness supporter for forming the igniter body are made of an insulating member, when the igniter is fitted to, for example, an air bag inflation gas generator, the igniter body is surely prevented from being charged with static electricity.

And, since one of the lead electrodes is electrically conducted to the header case, by connecting the other of the lead electrodes to ground, static electricity charged in the header case and others is lead to the grounding through the lead electrode.

DESCRIPTION OF THE PREFERRED EMBODIMENT OF THE INVENTION

Figure 1:
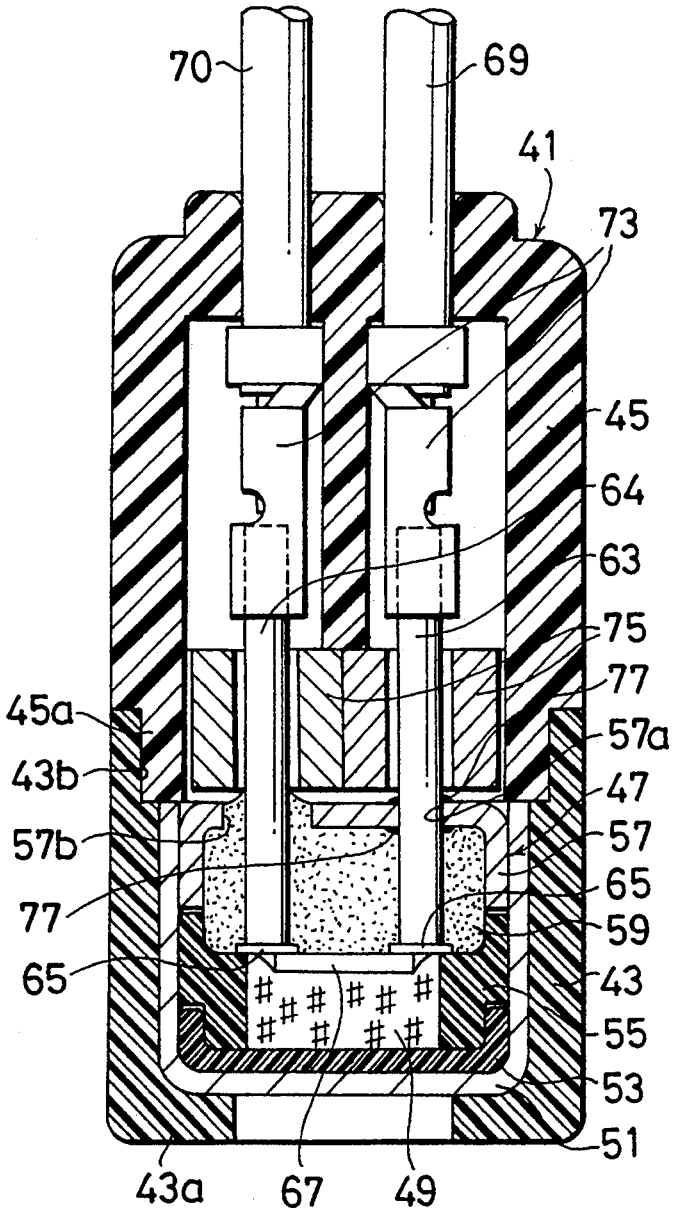
FIG. 1 is a longitudinal sectional view showing one embodiment of the igniter of this invention.
Figure 2:
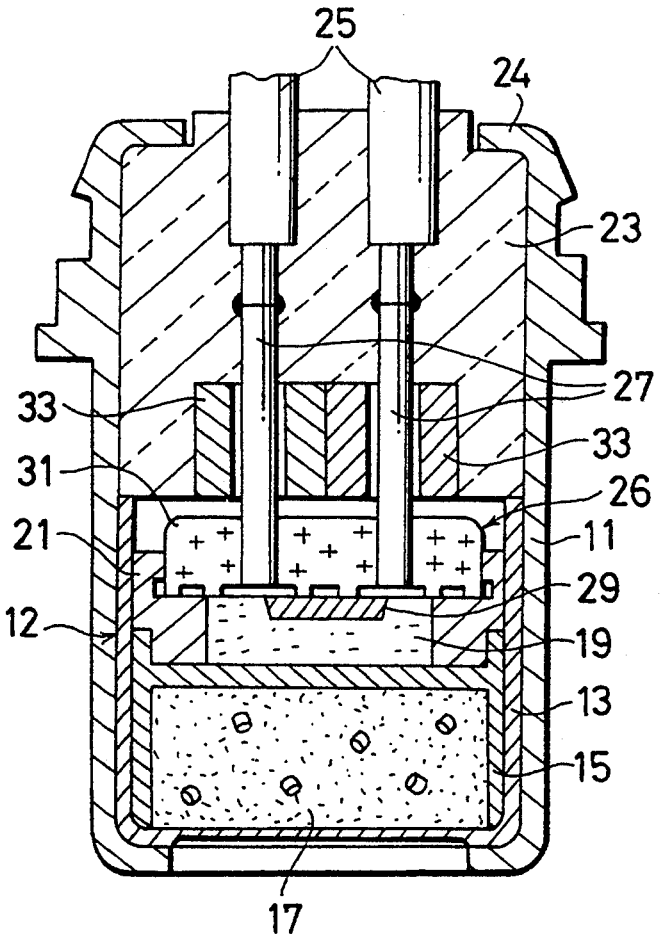
FIG.2 PRIOR ART
FIG. 2 is a longitudinal sectional view showing a conventional igniter.

Now, this invention will be described in detail with reference to one embodiment shown in the drawing.

FIG. 1 shows one embodiment of the igniter of this invention. In the drawing, the reference numeral 41 represents an igniter body which consists of an insulated cup 43 and a harness supporter 45.

The insulated cup 43 is made of resin such as Tefzel (trade name of Mitsui Fluorochemical Co., Ltd.).

The insulated cup 43 is cylindrical and has an inner flange **43*a* formed at the end and a mating hole 43*b*** formed at the rear end.

The harness supporter 45 is made of resin such as Teflon (trademark of Du Pont).

At the leading end of the harness supporter 45, a mating section **45*a* is formed, which is fitted with the mating hole 43*b* of the insulated cup 43**.

Within the insulated cup 43, a header 47 and an igniting agent 49 are disposed.

At the leading end of the insulated cup 43, a cup 51 made of metal such as covar is inserted and, at the bottom of the cup 51, a separator 53 made of resin is inserted.

In the separator 53, the leading end of a charge holder 55 made of resin for example is inserted and, the back of the charge holder 55 is inserted to the middle of the cup 51.

From the opening of the cup 51, a header case 57 made of metal such as covar is inserted.

A glass sintered member 59 is charged into the header case 57 and, the front of the glass sintered member 59 is mated with the back of the charge holder 55.

A pair of lead electrodes 63, 64 is inserted with a certain interval therebetween through the glass sintered member 59 and the header case 57.

Heads 65 of the lead electrodes 63, 64 are embedded into the glass sintered member 59 excepting their ends.

And, a thin film resistor type heater member 67 is bridged between the heads 65.

In a space formed between the front of the heater member 67 and the separator 53, the igniting agent 49 is accommodated.

At the bottom of the harness supporter 45, a pair of harnesses 69, 70 is inserted with a certain interval therebetween.

These harnesses 69, 70 are electrically connected with the back end of the lead electrodes 63, 64 via a crimp-style terminal 73 within the harness supporter 45.

To the projections projecting from the header case 57 of the lead electrodes 63, 64, ferrite beads 75 are fitted.

And, in this embodiment, between the pair of lead electrodes 63, 64, the lead electrode 63 to which the harness 69 on the ground side is connected is electrically conducted to the header case 57.

More specifically, at the bottom of the header case 57, a small-diameter hole 57*a* and a large-diameter hole 57*b* are formed. And, the lead electrode 63 is inserted into the small-diameter hole 57*a* and the lead electrode 64 into the large-diameter hole 57*b*.

The lead electrode 63 inserted into the small-diameter hole 57*a* is fixed to the header case 57 by silver-alloy brazing 77.

The aforementioned igniter is disposed at a certain position of, for example, an air bag inflation gas generator to ignite an ignition agent for igniting gas generating agents. And, when a car crashes, electricity is sent to the heater member 67 through the harnesses 69, 70 and the lead electrodes 63, 64. The temperature of the heater member 67 rises and the igniting agent 49 is ignited, resulting in burning the ignition agent.

In the igniter configured as described above, since the insulated cup 43 and the harness supporter 45 for forming the igniter body 41 are formed of insulating resin and the lead electrode 63 which is connected to the ground is electrically conducted to the header case 57, ignition of the igniting agent 49 due to discharge of static electricity can be surely prevented.

More specifically, in the aforementioned igniter, the insulated cup 43 and the harness supporter 45 for forming the igniter body 41 are formed of insulating resin, and when the igniter is fitted to an air bag inflation gas generator for example, the igniter body 41 is prevented from being charged with static electricity; and since the lead electrode 63 which is connected to the ground is electrically conducted to the header case 57, static electricity generated in the header case 57 and others is lead to the ground through the lead electrode 63. Therefore, static electricity is not accumulated in the igniter in a large volume, and ignition of the igniting agent 49 due to discharge of static electricity can be surely prevented, In the embodiment described above, the insulated cup and the harness supporter have been described to be made of resin but this invention is not limited to the above embodiment. And, it is needless to say that they may be formed of ceramics.

Furthermore, in the embodiment described above, the lead electrode 63 has been described to be fixed to the header case 57 by silver-alloy brazing 77 but this invention is not limited to the above embodiment. And, it is needless to say that fixing may be made by welding such as electric welding or the like.

What is claimed is:

1. An igniter comprising:

an insulated cup made of an insulating member, the insulated cup for accommodating an igniting agent and a header, the insulated cup having a rear end, the rear end of the insulated cup adapted for engaging a harness supporter;

an igniting agent in said insulated cup;

a header for igniting the igniting agent, the header having a header case made of conductive metal, a glass sintered member charged into the header, a pair of lead electrodes inserted into the header at a certain interval therebetween, wherein each of the lead electrodes includes a leading end and a rear end, the rear end of each of the lead electrodes having a harness connected thereto, a heater member for heating the igniting agent, the heater member being bridged between the leading ends of the lead electrodes; and a harness supporter made of an insulating member, the harness supporter including a preformed mating section at a leading end of the harness supporter engaging the rear end of the insulated cup, the harness supporter having a pair of harnesses inserted into the harness supporter at a certain interval therebetween;

whereby the insulated cup is joined to the harness supporter forming an igniter body; and one of the lead electrodes is electrically conducted to the header case grounding static electricity.

2. An igniter according to claim 1, wherein said insulated cup and said harness supporter are made of resin.

3. An igniter according to claim 1, wherein said insulated cup and said harness supporter are made of ceramics.

4. An igniter according to claim 1, wherein the header case is bottom-closed and cylindrical.

5. An igniter according to claim 1, wherein the preformed mating section includes a surface for receiving the insulated cup, and the insulated cup has a corresponding mating section at its rear end for being fitted over the recessed mating surface of the harness supporter.

* * * * *